US006866818B2

(12) United States Patent
Boegel et al.

(10) Patent No.: US 6,866,818 B2
(45) Date of Patent: Mar. 15, 2005

(54) METHOD OF USING A SPRAY FORMED COPPER-NICKEL-MANGANESE ALLOY

(75) Inventors: Andreas Boegel, Weissenhorn (DE); Klaus Ohla, Illerkirchberg (DE); Hilmar R. Mueller, Bellenberg (DE); Frank Michael Keppeler, Stuttgart (DE); Hendrik John, Celle (DE)

(73) Assignee: Wieland-Werke AG, Ulm (DE)

( * ) Notice: Subject to any disclaimer, the term of this patent is extended or adjusted under 35 U.S.C. 154(b) by 121 days.

(21) Appl. No.: 10/125,291

(22) Filed: Apr. 18, 2002

(65) Prior Publication Data

US 2002/0166609 A1 Nov. 14, 2002

(30) Foreign Application Priority Data

Apr. 19, 2001 (EP) ..... 01109660

(51) Int. Cl.[7] ..... C22C 1/00
(52) U.S. Cl. ..... 420/590; 420/487; 148/435
(58) Field of Search ..... 148/435; 420/487, 420/590

(56) References Cited

U.S. PATENT DOCUMENTS 2,234,552 A 3/1941 Dean et al.

FOREIGN PATENT DOCUMENTS

| | | | |
|---|---|---|---|
| EP | 0 225 080 | | 6/1987 |
| EP | 0 225 732 | | 6/1987 |
| GB | 577170 | * | 5/1946 |
| GB | 1 379 261 | | 1/1975 |
| GB | 1 599 392 | | 9/1981 |

OTHER PUBLICATIONS

Vinogradov, V.N.;Korotkov,V.A.;Obishchenko, L.N.; Perosyants, A.A., Composite material as an important reserve for increasin the life of gas and petroleum equipment, Trenie i Iznos (1982), 3(3), 428–35. (Provided with abstract only).*

Chemical Abstracts, vol. 81, No. 18, Nov. 4, 1974 "New Materials in Gas and Petroleum Industry Machine Building".

Chemical Abstracts, vol. 87, No. 8, Aug. 22, 1977 "Increasing the Work Efficiency of a Cutter Reinforced with a Composite Material".

Specification for Rotary Drill Stem Elements, API Specification 7, by American Petroleum Institute, Apr. 1, 1994 (pp. 20–25).

* cited by examiner

*Primary Examiner*—Sikyin Ip
(74) *Attorney, Agent, or Firm*—Flynn, Thiel, Boutell & Tanis, P.C.

(57) ABSTRACT

A method for the manufacture of tools and components for the offshore field and the mining industry, in particular, for drilling installations, using a spray formed Cu—Ni—Mn alloy of 10 to 25% Ni, 10 to 25% Mn, the remainder being copper and common impurities. Due to the favorable characteristics of the combination, the alloy is suitable as a replacement material for Be-containing copper materials.

5 Claims, No Drawings

METHOD OF USING A SPRAY FORMED COPPER-NICKEL-MANGANESE ALLOY

FIELD OF THE INVENTION

The invention relates to a method for the manufacture of tools and components for the offshore field and the mining industry, in particular for drilling installations using a spray formed copper-nickel-manganese alloy.

BACKGROUND OF THE INVENTION

Mechanical components (as for example drilling rods, screw couplings, bolts, etc.) are demanded for high stress situations in offshore engineering, which components must, among others, have a high capacitance and very good corrosion characteristics, and may neither be ferromagnetic nor cause explosions or fire during impacting one another through pyrophorous reactions of flying fragments.

The following, specific characteristics are demanded for the materials used in this field. These are:

1. Magnetic Characteristics:

In order to meet metrological demands of a drill string in the area of compass measuring systems (measuring the Earth's magnetic field and direction information, which can be derived therefrom) drill string components must be nonmagnetic in this area since in the presence of magnetic materials faulty measurements due to the influence of the magnetic field occur. The magnetic susceptibility X should accordingly not exceed $20 \cdot 10^{-6}$.

(X indicates thereby according to the Equation $\vec{M} = \mu_o \cdot X \cdot \vec{H}$ the relationship of the magnetization $$\vec{M}\ \left[\frac{Vs}{m^2}\right]$$

with respect to the magnetic field strength $$\vec{H}\ \left[\frac{A}{m}\right],$$

with $$\mu_o = 4\Pi \cdot 10^{-7} = 1.256 \cdot 10^{-6}\ \left[\frac{Vs}{Am}\right]$$

as magnetic field constant.)

2. Yield Strength/Hardness:

The drill string is subjected to high mechanical and physical/chemical stress. The individual string elements are connected with one another by threaded connections. Due to the high forces which occur in the drill hole, the individual string elements are screwed together by applying high torques. In order to avoid plastic deformations of the threads, the material must have a high yield strength. The drill string surfaces are stressed by abrasion and erosion. The wear is reduced to a minimum by an as high as possible material hardness.

3. Toughness:

The exact stress collectives are as a rule unknown. However, tests on damages, which have occurred, have shown that very high vibration and sudden stresses can occur. The toughness of the materials being utilized therefore plays a decisive role for the safe functioning. The toughness of the copper alloy being utilized should therefore be maximized with respect to strength level and should as much as possible be even over its cross section.

4. Corrosion Resistance:

The rock formations are mechanically destroyed at the bottom of the drill hole and are pumped to the surface by a so-called drill flushing. Increased temperatures and the chemical or physical-chemical attack by the drilling fluid demand a high corrosion resistance of the materials being used. The material must, in particular in sulphur-containing media, be resistant to stress corrosion cracking.

5. Galling:

The screwed connection of the individual drill-string elements under high torque may not result in a cold welding ("galling"). Therefore heterogeneous materials (for example, steel with NE-metal) are as much as possible supposed to be connected with one another. Therefore intermediate pieces out of a high-strength copper alloy are often screwed in-between in the case of thread connections of drill-string components out of austenitic, nonmagnetizable steels. For example, copper-beryllium (UNS C 17200) was used up to now as a suitable copper material.

Components and tools of copper materials, in particular of CU—BE alloys, were utilized according to the state of the art for these demands, which alloys unite these characteristics in a special manner. The copper-beryllium intermediate pieces, which are used in austenitic, nonmagnetizable drill stems (so-called "drill collars"), are valid as an example here.

As environmental concerns become increasingly stronger, viewpoints regarding environmental friendliness and health hazards move increasingly to the center of interest. Any type of criticism must be avoided.

Due to possible health hazardous effects of Be dusts and vapors, which can occur during improper working of Be containing materials, the demand for Be-free materials therefore increases.

The basic purpose of the invention is therefore to find a copper material which meets also as broadly as possible the demanded characteristic profile, however, is Be-free thereby.

The purpose is attained according to the invention by the use of a spray-formed copper-nickel-manganese alloy which consists of 10 to 25% nickel, 10 to 25% manganese, the remainder being copper and the usual impurities (the percentage information relates to the weight).

It has now been found surprisingly that with Cu—Ni—Mn alloys of the suggested Be-free composition, not only can all demands be met but also considerable advantages in availability compared with the common Cu—Be alloys are achieved and when combined with manufacture through spray forming, a selectively better technological suitability is found, in particular, the demands for drill string components according to the API (American Petroleum Institute) Specification 7 ("Specification for Rotary Drill Stem Elements") $38^{th}$ Ed., Apr. 1, 1994, are met.

Copper-nickel-manganese alloys as such are already known (compare, for example, U.S. Pat. No. 2,234,552/DEAN) and it is known, for example, also in the field of the electric and electronic components, to replace the relatively expensive Cu—Be alloys with inexpensive copper-nickel-manganese alloys, however, the claimed purpose of use for a spray formed alloy of this type is not known.

The original forming process for the copper material occurs through spray-forming (compare the so-called "OSPREY" process, for example, according to the GB Patents 1,379,261/1,599,392 or EP Patent 0,225,732). Bolts can be used as the blank, which bolts are processed through typical hot forming methods (pressing, rolling, forging) into semifinished products (rods, tubes, profiles, sleeves).

What is claimed is:

1. In a method of making tools and components for offshore field and mining industries for use in drilling installations, the improvement comprising making said tools and components from a spray-formed copper-nickel-manganese alloy having a medium grain size $D_K$ equal to 5–70 $\mu$m and consisting of 10 to 25% nickel, 10 to 25% manganese, and the remainder being copper and common impurities.

2. The method according to claim 1, wherein the alloy contains 17 to 23% nickel and 17 to 23% manganese.

3. The method according to claim 1, wherein the alloy contains 19.5 to 20.5% nickel and 19.5 to 20.5% manganese.

4. The method according to claim 1, wherein the alloy has a homogeneous distribution with little segregation of all alloy elements.

5. The method according to claim 1, wherein the alloy, as a material, meets the demands according to American Petroleum Institute Specification 7, $38^{th}$ Ed., Apr. 1, 1994.

* * * * *